US006955587B2

(12) United States Patent
Muldowney

(10) Patent No.: US 6,955,587 B2
(45) Date of Patent: Oct. 18, 2005

(54) GROOVED POLISHING PAD AND METHOD

(75) Inventor: Gregory P. Muldowney, Glen Mills, PA (US)

(73) Assignee: Rohm and Haas Electronic Materials CMP Holdings, INC, Wilmington, DE (US)

( * ) Notice: Subject to any disclaimer, the term of this patent is extended or adjusted under 35 U.S.C. 154(b) by 0 days.

(21) Appl. No.: 10/769,395

(22) Filed: Jan. 30, 2004

(65) Prior Publication Data

US 2005/0170757 A1 Aug. 4, 2005

(51) Int. Cl.[7] ..... B24B 1/00

(52) U.S. Cl. ..... 451/41; 451/527; 451/528; 451/533; 451/921

(58) Field of Search ..... 451/41, 528, 529, 451/921, 527, 533

(56) References Cited

U.S. PATENT DOCUMENTS

| | | | | |
|---|---|---|---|---|
| 5,921,855 | A | 7/1999 | Osterheld et al. | |
| 5,990,012 | A | 11/1999 | Robinson et al. | |
| 6,120,366 | A * | 9/2000 | Lin et al. | 451/550 |
| 6,159,088 | A | 12/2000 | Nakajima | |
| 6,241,596 | B1 * | 6/2001 | Osterheld et al. | 451/527 |
| 6,315,857 | B1 | 11/2001 | Cheng et al. | |
| 6,354,919 | B2 | 3/2002 | Chopra | |
| 6,520,847 | B2 | 2/2003 | Osterheld et al. | |
| 6,648,743 | B1 * | 11/2003 | Burke | 451/526 |
| 6,729,950 | B2 * | 5/2004 | Park et al. | 451/528 |
| 6,783,436 | B1 * | 8/2004 | Muldowney | 451/41 |

FOREIGN PATENT DOCUMENTS

KR 2002-0022198 A 3/2002

OTHER PUBLICATIONS

US 6,273,808, 08/2001, Bennett et al. (withdrawn)

* cited by examiner

*Primary Examiner*—George Nguyen
(74) *Attorney, Agent, or Firm*—Blake T. Biederman

(57) ABSTRACT

A polishing pad (104, 300, 400, 500) for polishing a wafer (112, 516), or other article. The polishing pad includes a polishing layer (108) having a polishing region (164, 320, 420, 504) defined by first and second boundaries ((168, 172), (312, 316), (412, 416) (508, 512)) having shapes and locations that are a function of the size of polished surface (116) of the article being polished and the type of polisher (100) used. The polishing region has several zones ((Z1–Z3)(Z1'–Z3')(Z1"–Z3")(Z1'"–Z3'")) each containing corresponding grooves ((148, 152, 156)(304, 308, 324)(404, 408, 424)(520, 524, 528)) having orientations selected based on the direction of one or more velocity vectors (V1–V4)(V1'–V4')(V1"–V4") (V'"–V4'") of the wafer in that zone.

10 Claims, 3 Drawing Sheets

GROOVED POLISHING PAD AND METHOD

BACKGROUND OF THE INVENTION

The present invention generally relates to the field of polishing. In particular, the present invention is directed to a polishing pad having a groove pattern for reducing slurry mixing wakes in the grooves.

In the fabrication of integrated circuits and other electronic devices, multiple layers of conducting, semiconducting and dielectric materials are deposited onto and etched from a surface of a semiconductor wafer. Thin layers of conducting, semiconducting and dielectric materials may be deposited by a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating. Common etching techniques include wet and dry isotropic and anisotrdpic etching, among others.

As layers of materials are sequentially deposited and etched, the uppermost surface of the wafer becomes nonplanar. Because subsequent semiconductor processing (e.g., photolithography) requires the wafer to have a flat surface, the wafer needs to be planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize workpieces, such as semiconductor wafers. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad has a diameter greater than twice the diameter of the wafer being planarized. During polishing, each of the polishing pad and wafer is rotated about its concentric center while the wafer is engaged with the polishing layer. The rotational axis of the wafer is offset relative to the rotational axis of the polishing pad by a distance greater than the radius of the wafer such that the rotation of the pad sweeps out a ring-shaped "wafer track" on the polishing layer of the pad. When the only movement of the wafer is rotational, the width of the wafer track is equal to the diameter of the wafer. However, in some dual-axis polishers, the wafer is oscillated in a plane perpendicular to its axis of rotation. In this case, the width of the wafer track is wider than the diameter of the wafer by an amount that accounts for the displacement due to the oscillation. The carrier assembly provides a controllable pressure between the wafer and polishing pad. During polishing, a slurry, or other polishing medium, flows onto the polishing pad and into the gap between the wafer and polishing layer. The wafer surface is polished and made planar by chemical and mechanical action of the polishing layer and slurry on the surface.

The interaction among polishing layers, polishing slurries and wafer surfaces during CMP is being studied in an effort to optimize polishing pad designs. Most of the polishing pad developments over the years have been empirical in nature. Much of the design of polishing surfaces, or layers, has focused on providing these layers with various patterns of voids and networks of grooves that are claimed to enhance slurry utilization and polishing uniformity. Over the years, quite a few different groove and void patterns and configurations have been implemented. These groove patterns include radial, concentric circular, Cartesian grid and spiral, among others. Furthermore, these groove configurations include configurations wherein the width and depth of all the grooves are uniform among all grooves and configurations wherein the width or depth of the grooves varies from one groove to another.

Some designers of rotational CMP pads have designed pads having groove configurations that include two or more groove configurations that change from one configuration to another based on one or more radial distances from the center of the pad. These pads are touted as providing superior performance in terms of polishing uniformity and slurry utilization, among other things. For example, in U.S. Pat. No. 6,520,847, Osterheld et al. disclose several pads having three concentric ring-shaped regions, each containing a configuration of grooves that is different from the configurations of the other two regions. The configurations vary in different ways in different embodiments. Ways in which the configurations vary include variations in number, cross-sectional area, spacing and type of grooves.

Although pad designers have heretofore designed CMP pads that include two or more groove configurations that are different from one another in different zones of the polishing layer, these designs do not directly consider the effect of the groove configuration on the mixing wakes that occur in the grooves. FIG. 1 shows a plot 10 of the ratio of new slurry to old slurry during polishing at an instant in time within the gap (represented by circular region 14) between a wafer (not shown) and a conventional rotary polishing pad 18 having circular grooves 22. For the purposes of this specification, "new slurry" may be considered slurry that is moving in the rotational direction of polishing pad 18, and "old slurry" may be considered slurry that has already participated in polishing and is being held within the gap by the rotation of the wafer.

In plot 10, new slurry region 26 essentially contains only new slurry and old slurry region 30 essentially contains only old slurry at an instant in time when polishing pad 18 is rotated in direction 34 and the wafer is rotated in direction 38. A mixing region 42 is formed in which new slurry and old slurry become mixed with one another so as to cause a concentration gradient (represented by region 42) between new slurry region 26 and old slurry region 30. Computational fluid dynamics simulations show that due to the rotation of the wafer, slurry immediately adjacent to the wafer may be driven in a direction other than the rotational direction 34 of the pad, whereas slurry somewhat removed from the wafer is held among "asperities" or roughness elements on the surface of polishing pad 18 and more strongly resists being driven in a direction other than direction 34. The effect of wafer rotation is most pronounced at circular grooves 22 at locations where the grooves are at a small angle with respect to rotational direction 38 of the wafer because the slurry in the grooves is not held among any asperities and is easily driven by wafer rotation along the length of circular grooves 22. The effect of wafer rotation is less pronounced in circular grooves 22 at locations where the grooves are transverse to rotational direction 38 of the wafer because the slurry can be driven only along the width of the groove within which it is otherwise confined.

Mixing wakes similar to mixing wakes 46 shown occur in groove patterns other than circular patterns, such as the groove patterns mentioned above. Like circular-grooved pad 18 of FIG. 1, in each of these alternative groove patterns, the mixing wakes are most pronounced in regions where the rotational direction of the wafer is most aligned with the grooves, or groove segments, as the case may be, of the pad. Mixing wakes can be detrimental to polishing for a number of reasons, such as non-uniform polishing and increased defectivity. Consequently, there is a need for CMP polishing pad designs that are optimized, at least in part, based on the consideration of the occurrence of mixing wakes and the effects that such wakes have on polishing.

STATEMENT OF THE INVENTION

In one aspect of the invention, a polishing pad suitable for polishing at least one of magnetic, optical and semiconductor substrates, comprising: (a) a polishing layer having a polishing region defined by a first boundary defined by a trajectory of a first point on the polishing pad and a second boundary defined by a trajectory of a second point on the polishing pad, the second boundary being spaced from the first boundary; (b) a plurality of first large-angle grooves, each at least partially contained within the polishing region proximate the first boundary and being 45° to 135° at a point of intersection with the first boundary; (c) a plurality of second large-angle grooves, each at least partially contained within the polishing region proximate the second boundary and being 45° to 135° at a point of intersection with the second boundary; and (d) at least one small-angle groove contained within the polishing region and between the plurality of first large-angle grooves and the plurality of second large-angle grooves and being −30° to 30° with respect to the trajectory of the first boundary and the second boundary.

In another aspect of the invention, a method of polishing an magnetic, optical or semiconductor substrate, comprising the step of polishing the substrate with a polishing pad and polishing medium, the polishing pad comprising: (a) a polishing layer having a polishing region defined by a first boundary defined by a trajectory of a first point on the polishing pad and a second boundary defined by a trajectory of a second point on the polishing pad, the second boundary being spaced from the first boundary; (b) a plurality of first large-angle grooves, each at least partially contained within the polishing region proximate the first boundary and being 45° to 135° at a point of intersection with the first boundary; (c) a plurality of second large-angle grooves, each at least partially contained within the polishing region proximate the second boundary and being 45° to 135° at a point of intersection with the second boundary; and (d) at least one small-angle groove contained within the polishing region and between the plurality of first large-angle grooves and the plurality of second large-angle grooves and being −30° to 30° with respect to the trajectory of the first boundary and the second boundary.

DETAILED DESCRIPTION OF THE INVENTION

Figure 2:
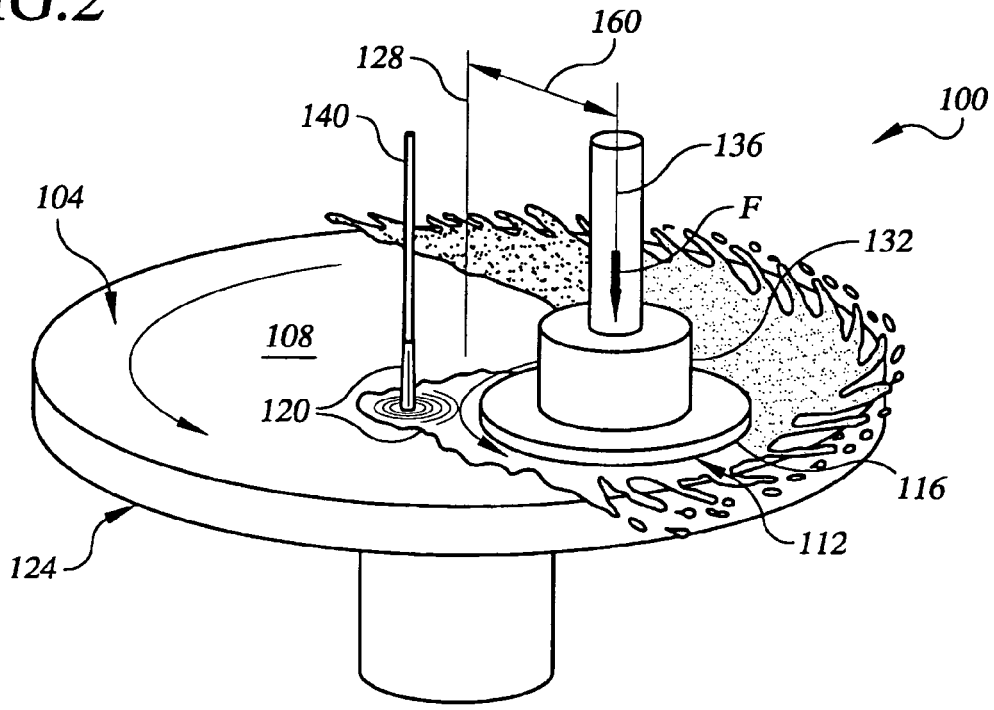
FIG. 2 is a perspective view of a portion of a dual-axis polisher suitable for use with the present invention.

Referring again to the drawings, FIG. 2 generally illustrates the primary features of a dual-axis chemical mechanical polishing (CMP) polisher 100 suitable for use with the present invention. Polisher 100 generally includes a polishing pad 104 having a polishing layer 108 for engaging an article, such as semiconductor substrates, including semiconductor wafer 112 (processed or unprocessed); optical substrates including glass and flat panel displays; and substrates for storing magnetic information, including nickel disks, so as to effect polishing of the polished surface 116 of the workpiece in the presence of a slurry 120 or other polishing medium. For the sake of convenience, the terms "wafer" and "slurry" are used below without the loss of generality. In addition, as used in this specification, including the claims, the terms "polishing medium" and "slurry" include particle-containing polishing solutions and non-particle-containing solutions, such as abrasive-free and reactive-liquid polishing solutions.

As discussed below in detail, the present invention includes providing polishing pad 104 with a groove arrangement (see, e.g., groove arrangement 144 of FIG. 3A) that inhibits the formation of mixing wakes or reduces the size of the mixing wakes that occur in the gap between wafer 112 and polishing pad 104 during polishing. As discussed in the background section above, mixing wakes occur in the gap where new slurry replaces old slurry and are most pronounced in regions where the rotational direction of wafer 112 is most aligned with the grooves, or groove segments, as the case may be, of polishing pad 104.

Polisher 100 may include a platen 124 on which polishing pad 104 is mounted. Platen 124 is rotatable about a rotational axis 128 by a platen driver (not shown). Wafer 112 may be supported by a wafer carrier 132 that is rotatable about a rotational axis 136 parallel to, and spaced from, rotational axis 128 of platen 124. Wafer carrier 132 may feature a gimbaled linkage (not shown) that allows wafer 112 to assume an aspect very slightly non-parallel to polishing layer 108, in which case rotational axes 128, 136 may be very slightly askew. Wafer 112 includes polished surface 116 that faces polishing layer 108 and is planarized during polishing. Wafer carrier 132 may be supported by a carrier support assembly (not shown) adapted to rotate wafer 112 and provide a downward force F to press polished surface 116 against polishing layer 108 so that a desired pressure exists between the polished surface and the polishing layer during polishing. Polisher 100 may also include a slurry inlet 140 for supplying slurry 120 to polishing layer 108.

As those skilled in the art will appreciate, polisher 100 may include other components (not shown) such as a system controller, slurry storage and dispensing system, heating system, rinsing system and various controls for controlling various aspects of the polishing process, such as: (1) speed controllers and selectors for one or both of the rotational rates of wafer 112 and polishing pad 104; (2) controllers and selectors for varying the rate and location of delivery of slurry 120 to the pad; (3) controllers and selectors for controlling the magnitude of force F applied between the wafer and pad, and (4) controllers, actuators and selectors for controlling the location of rotational axis 136 of the wafer relative to rotational axis 128 of the pad, among others. Those skilled in the art will understand how these components are constructed and implemented such that a detailed explanation of them is not necessary for those skilled in the art to understand and practice the present invention.

During polishing, polishing pad 104 and wafer 112 are rotated about their respective rotational axes 128, 136 and slurry 120 is dispensed from slurry inlet 140 onto the rotating polishing pad. Slurry 120 spreads out over polishing layer 108, including the gap beneath wafer 112 and polishing pad 104. Polishing pad 104 and wafer 112 are typically, but not necessarily, rotated at selected speeds between 0.1 rpm and to 150 rpm. Force F is typically, but not necessarily, of a magnitude selected to induce a desired pressure of 0.1 psi to 15 psi (6.9 to 103 kPa) between wafer 112 and polishing pad 104.

Figure 1:
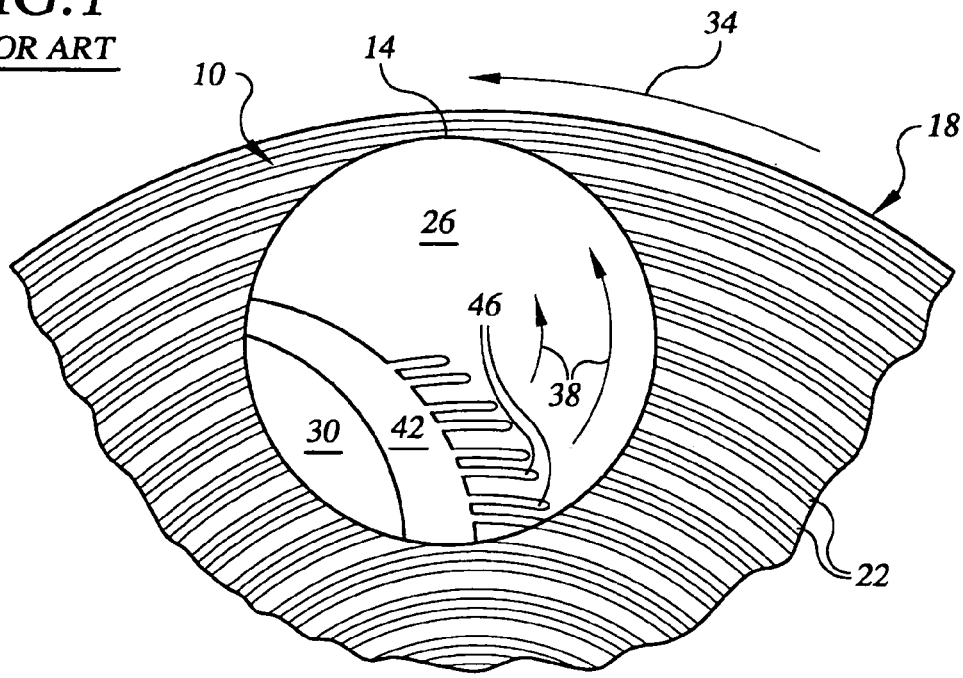
FIG.1 PRIOR ART
FIG. 1 is a partial plan view/partial plot illustrating the formation of mixing wakes in the gap between a wafer and a prior art polishing pad having a circular groove pattern.
Figure 3A:
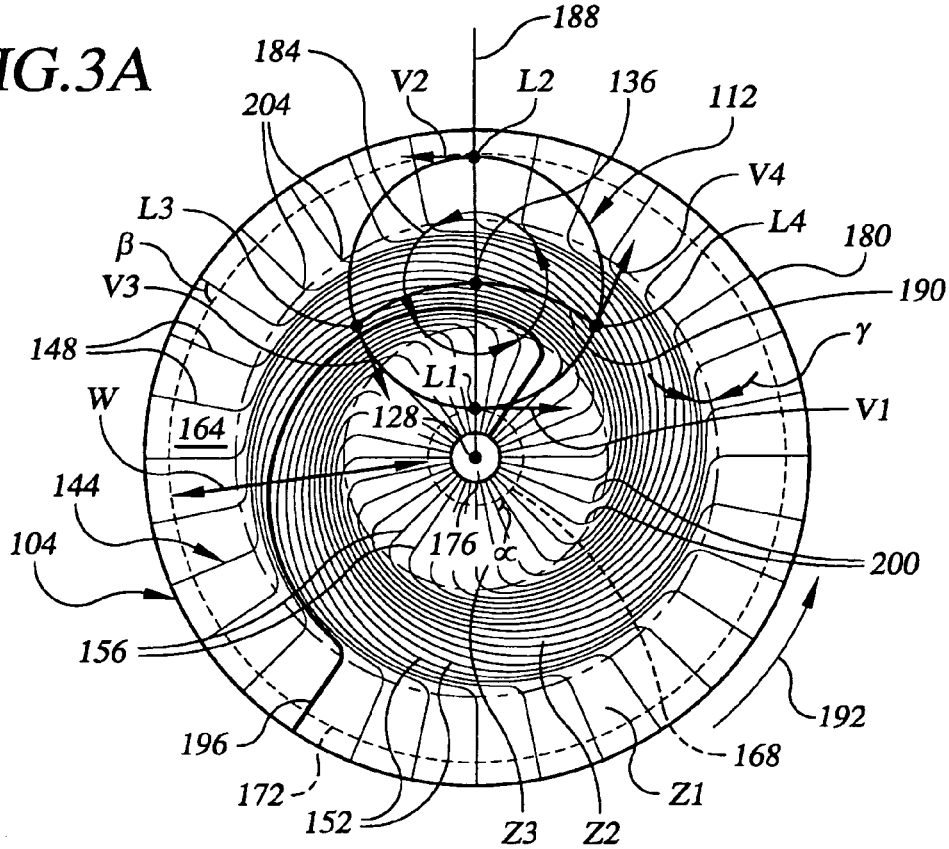
FIG. 3A is a plan view of a rotary polishing pad of the present invention.

FIG. 3A illustrates in connection with polishing pad 104 of FIG. 2, a groove pattern 144 that, as mentioned above, inhibits the formation of mixing wakes (elements 46 of FIG. 1) or reduces the size of mixing wakes within grooves 148, 152, 156 present in the polishing layer 108 of the pad. Generally, the concept underlying the present invention is to provide grooves 148, 152, 156 that are at a large angle with respect to the tangential velocity vectors of wafer 112 at all locations on polishing layer 108, or at as many locations as possible. If rotational axis 136 of wafer 112 were coincident with rotational axis 128 of the polishing pad 104, the ideal groove pattern according to the present invention would be one in which the grooves radiate outward from the rotational axis of the pad. However, in dual-axis polishers, such as polisher 100 illustrated in FIG. 2, the situation is complicated by the offset 160 between rotational axes 128, 136 of polishing pad 104 and wafer 112.

Nevertheless, it is possible to design a polishing pad, e.g., pad 104, for use with a dual-axis polisher that approximates the ideal groove pattern possible when polishing is performed when rotational axes 136, 128 of wafer 112 and the pad are coincident. As a result of offset 160 (FIG. 1) between rotational axes 128, 136, the act of polishing causes polishing pad 104 to sweep out polishing region 164 (commonly referred to as the "wafer track" in the context of semiconductor wafer planarization) defined by an inner boundary 168 and an outer boundary 172 each defined by a trajectory of a point on the polishing pad 104. For rotary polishing pads, inner boundary 168 and outer boundary 172 represent circles. Generally, polishing region 164 is that portion of polishing layer 108 that confronts the polished surface (not shown) of wafer 112 during polishing as polishing pad 104 is rotated relative to the wafer. In the embodiment shown, polishing pad 104 is designed for use with polisher 100 of FIG. 2, wherein wafer 112 is rotated in a fixed position relative to the pad. Consequently, polishing region 164 is annular in shape and has a width W between inner and outer boundaries 168, 172 that is equal to the diameter of the polished surface of wafer 112. In an embodiment wherein wafer 112 is not only rotated, but also oscillated in a direction parallel to polishing layer 108, polishing region 164 would typically likewise be annular, but width W between inner and outer boundaries 168, 172 would be greater than the diameter of the polished surface of wafer 112 to account for the oscillation envelope.

Inner boundary 168 of polishing region 164 defines a central region 176 where a slurry (not shown), or other polishing medium, may be provided to polishing pad 104 during polishing. In an embodiment wherein wafer 112 is not only rotated but also oscillated in a direction parallel to polishing layer 108, central region 176 may be exceedingly small if the oscillation envelope extends to, or nearly to, the center of polishing pad 104, in which case the slurry or other polishing medium may be provided to the pad at an off-center location. Outer boundary 172 of polishing region 164 will typically be located radially inward of the outer peripheral edge 180 of polishing pad 104, but may alternatively be coextensive with this edge.

In designing groove pattern 144 in a manner that reduces or minimizes the number of occurrences where rotational direction 184 of wafer 112 is aligned with grooves 148, 152, 156 or segments thereof, it is useful to consider the velocity of the wafer at four locations L1, L2, L3, L4, two along a line 188 extending through rotational axes 128, 136 of polishing pad 104 and the wafer, and two along a circular arc 190 concentric with the rotational axis of the pad and extending through the rotational axis of the wafer. This is so because these locations represent four velocity vector extremes of wafer 112 relative to the rotational direction 192 of polishing pad 104. That is, location L1 represents the location where a velocity vector V1 of wafer 112 is essentially directly opposite rotational direction 192 of polishing pad 104 and has the greatest magnitude in this direction, location L2 represents the location where a velocity vector V2 of the wafer is essentially in the same direction as the rotational direction of the pad and has the greatest magnitude in this direction, and locations L3 and L4 represent the locations where respective velocity vectors V3 and V4 of the wafer are at large angles to the rotational direction of the pad and have the greatest magnitude in such directions. It is at locations L1–L4 that principles underlying the present invention may be applied so as to approximate the ideal groove pattern discussed above.

As can be easily appreciated, consideration of velocity vectors V1–V4 of wafer 112 at these four locations L1–L4 generally leads to the partitioning of polishing region 164 into three zones, zone Z1 corresponding to location L1, zone Z2 corresponding to both locations L3 and L4 and zone Z3 corresponding to location L2. Width W of the wafer track may be apportioned among zones Z1–Z3 generally in any manner desired. For example, zones Z1 and Z3 may each be allotted one-quarter of width W and zone Z3 may be allotted one-half of width W. Other apportionment, such as one-third W may be allotted to each of zones Z1, Z2 and Z3, respectively, among others. Preferably the polishing pad 104 polishes a semiconductor wafer with a plurality of first large-angle grooves of zone Z1, the plurality of second large-angle grooves zone Z3 and the at least one small-angle groove zone Z2 simultaneously adjacent the semiconductor wafer simultaneously for at least a portion of the polishing.

Applying the underlying principles of the present invention, i.e., providing grooves 148, 152, 156 that are at large angles to velocity vectors of wafer 112, to zone Z1 based upon the velocity vector at location L1, shows that radial grooves 148 are desirable in zone Z1. This is so because velocity vector V1 is essentially perpendicular to radial grooves 148. It is noted that grooves 148 may extend beyond inner boundary 168 toward, or to, rotational axis 128. As can be appreciated, radial grooves 148 are perpendicular to inner boundary 168 of polishing region 164. It is noted that grooves 148 need not be truly radial. Rather, each groove 148 may form an angle $\alpha$ with inner boundary 168 other than 90°. Generally, angle $\alpha$ represents a large angle, preferably in the range of 45° to 135°, more preferably 60° to 120° and, most preferably, within the range of 75° to 105°. In addition, it is noted that each groove 148 need not be linear, but rather may be curved, zigzag, wavy or sawtooth-shaped, among others. Generally, for zigzag, wavy, sawtooth-shaped and like grooves, angle $\alpha$ is measured from the transverse centerline of the groove in the global rather than local sense, that is, the center location of the groove when averaged over several units of repeating shape (waves or zigzags).

The requirements for zone Z3 relative to grooves 156 are essentially the same as the requirements for zone Z1, the primary difference being that velocity vector V2 at location L2 is opposite velocity vector V1 at location L1. Accordingly, grooves 156 may be radial like grooves 148 of zone Z1 so as to form an angle β of 90° with respect to outer boundary 172. However, like grooves 148, grooves 156 need not be truly radial. Rather, each groove 152 may form an angle β with outer boundary 172 other than 90°. Generally, angle β represents a large angle, preferably in the range of 45° to 1350, more preferably 60° to 120° and, most preferably, within the range of 750 to 105°. In addition, like grooves 148, each groove 156 need not be linear, but rather may be curved, zigzag, wavy or sawtooth-shaped, among others. Also like grooves 148, for zigzag, wavy, sawtooth-shaped and like grooves 156, angle β can be measured from a line that generally represents the transverse center of the groove in the global sense, averaged over several units of repeating shape.

Velocity vectors V3 and V4 of wafer 112 in zone Z2 are perpendicular to velocity vectors V1 and V2 in zones Z1 and Z3, respectively. In order to make grooves 152 in zone Z2 at a large angle with respect to velocity vectors V3 and V4, these grooves may be parallel, or at a small angle with respect to inner and outer boundaries 168, 172 of polishing region 164. In this connection, each groove 152 preferably forms a small angle γ with either inner boundary 168 or outer boundary 172 of −30° to 30°, and more preferably −15° to 15°. If grooves 152 are not parallel with inner and outer boundaries 168, 172 (and with each other), they may, but need not, all be uniformly spaced from each other such as shown in FIG. 3A. If desired, grooves 152, or portions thereof, may cross over one another in opposite directions so as to form a rhomboidal grid (not shown) or other pattern, as discussed below in connection with FIG. 3B.

Corresponding respective ones of grooves 148, grooves 152 and grooves 156 may, but need not, be connected with one another as shown so as to form continuous channels (one of which is highlighted in FIG. 3A and identified by element numeral 196) extending from a location proximate rotational axis 128 and through and beyond polishing region 164. Providing continuous channels 196 as shown can be beneficial to slurry utilization and aid in the flushing of polish debris and removal of heat. Each groove 148 may be connected to a corresponding respective one of grooves 152 at a first transition 200 and, likewise, each groove 152 may be connected to a corresponding respective one of grooves 156 at a second transition 204. Each of first and second transitions 200, 204 may be gradual, e.g., the curved transitions shown, or abrupt, e.g., where the connected ones of grooves 148, 152, 156 form a sharp angle with one another, as desired to suit a particular design.

Although polishing region 164 has been described as being partitioned into three zones Z1–Z3, those skilled in the art will readily appreciate that the polishing region may be apportioned into a greater number of zones if desired. However, regardless of the number of zones provided, the process of laying out the grooves, e.g., grooves 148, 152, 156, in each zone may be the same. That is, in each zone the orientation(s) of the grooves therein may be selected to be at a large angle with respect to a velocity vector (similar to velocity vectors V1–V4) at a corresponding location (similar to locations L1–L4).

For example, two additional zones (not shown), one between zones Z1 and Z2 and one between zones Z2 and Z3, may be added as follows. Four additional locations for four additional velocity vectors may first be determined using two additional circular arcs (each similar to circular arc 190) that are each concentric with rotational axis 128 of polishing pad 104. One of the additional arcs may be located so as to intersect line 188 midway between location L1 and rotational axis 136 of wafer 112 and the other may be located so as to intersect line 188 midway between the rotational axis of the wafer and location L2. The additional locations for the velocity vectors could then be selected to be the four points where the two new circular arcs intersect outer peripheral edge 180 of wafer 112. The two additional zones would then correspond to the two additional circular arcs in a manner similar to the correspondence of zone Z2 to circular arc 190 and corresponding locations Z3 and Z4. The additional velocity vectors of wafer 112 could then be determined for the four additional locations and new grooves oriented relative to the additional velocity vectors as discussed above relative to grooves 148, 152, 156.

Figure 3B:
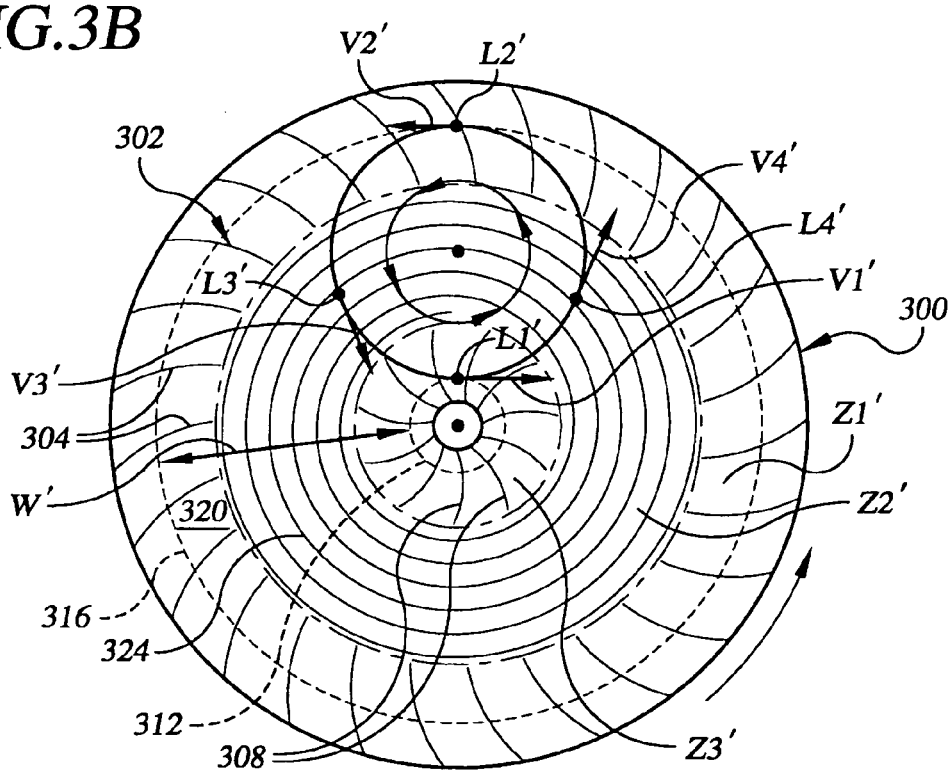
FIG. 3B is a plan view of an alternative rotary polishing pad of the present invention.
Figure 3C:
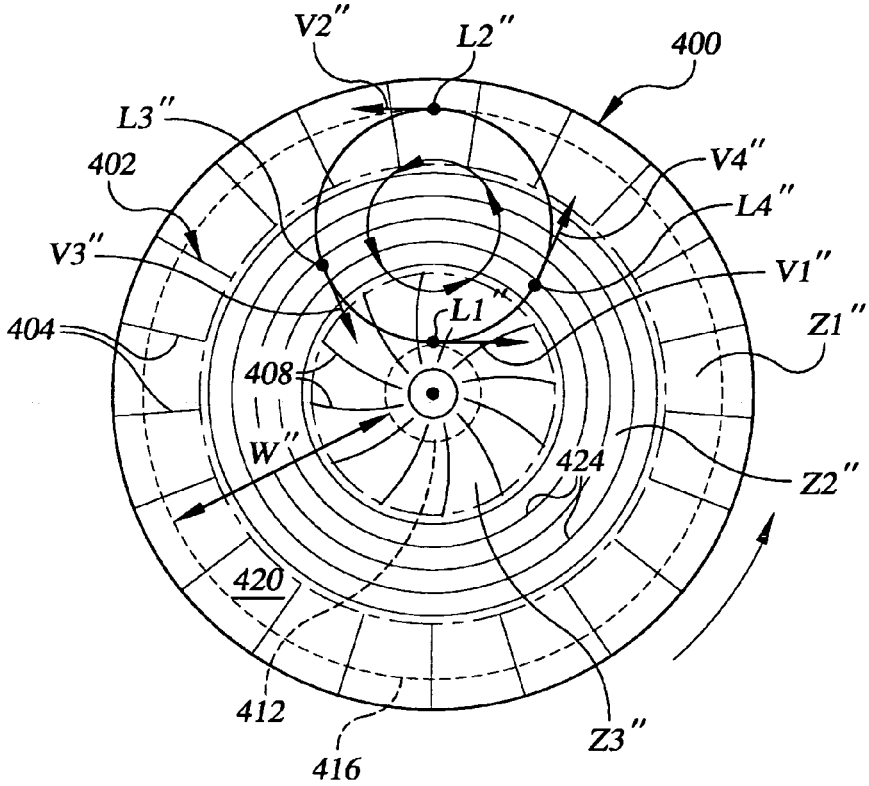
FIG. 3C is a plan view of another alternative rotary polishing pad of the present invention.

FIGS. 3B and 3C each show a polishing pad 300, 400 each having a groove pattern 302, 402 that is generally a variation on groove pattern 144 of FIG. 3A that captures the underlying concepts of the present invention. FIG. 3B shows zones Z1' and Z3' as partially containing grooves 304, 308, respectively, that are each generally radial and at a large angle with respect to the corresponding one of inner and outer boundaries 312, 316 of polishing region 320, but curve in opposite directions from one another. Of course, grooves 312, 316 may have other shapes and orientations, such as the shapes and orientations discussed above in connection with FIG. 3A. FIG. 3B also shows zone Z2' as containing a single spiral groove 324, wherein at any point there along, the groove is at a small angle with respect to inner and outer boundaries 312, 316 (and also at a large angle with respect to grooves 304, 308). It can be readily seen that groove pattern 302 provides, in accordance with the present invention, grooves 304 that are at a large angle with respect to velocity vector V1', grooves 308 that are at a large angle with respect to velocity vector V2' and groove 324 that is at a large angle with respect to velocity vectors V3' and V4', so as to inhibit the formation and extent of mixing wakes that form in these grooves during polishing. Width W' may be apportioned to zones Z1'–Z3' in any suitable manner, such as one-quarter W'/one-half W'/one-quarter W' or one-third W' to each, among others.

As mentioned above relative to FIG. 3A, zone Z2 may contain grooves 152, or portions thereof, that cross one another. This can be readily envisioned in the context of spiral groove 324 of FIG. 3B. For example, in addition to counterclockwise spiral groove 324 shown, zone Z2' may also contain a similar clockwise spiral groove (not shown), that must necessarily cross the counterclockwise spiral groove at many locations.

FIG. 3C shows zones Z1" and Z3" as partially containing grooves 404, 408, respectively, that are each generally radial and at a large angle with respect to the corresponding one of inner and outer boundaries 412, 416 of polishing region 420. Of course, grooves 404, 408 may have other shapes and orientations, such as the shapes and orientations discussed above in connection with FIG. 3A. FIG. 3C further shows zone Z2" as containing a plurality of circular grooves 424 that are each parallel to inner and outer boundaries 412, 416. Like FIGS. 3A and 3B, it can be readily seen that groove pattern 402 provides, in accordance with the present invention, grooves 404 that are at a large angle with respect to velocity vector V1", grooves 408 that are at a large angle with respect to velocity vector V2" and grooves 412 that are at a large angle with respect to velocity vectors V3" and V4", so as to inhibit the formation and extent of mixing wakes that form in these grooves during polishing. Width W" may be apportioned to zones Z1"–Z3" in any suitable manner, such as one-quarter W"/one-half W"/one-quarter W" or one-third W" to each, among others.

Figure 4:
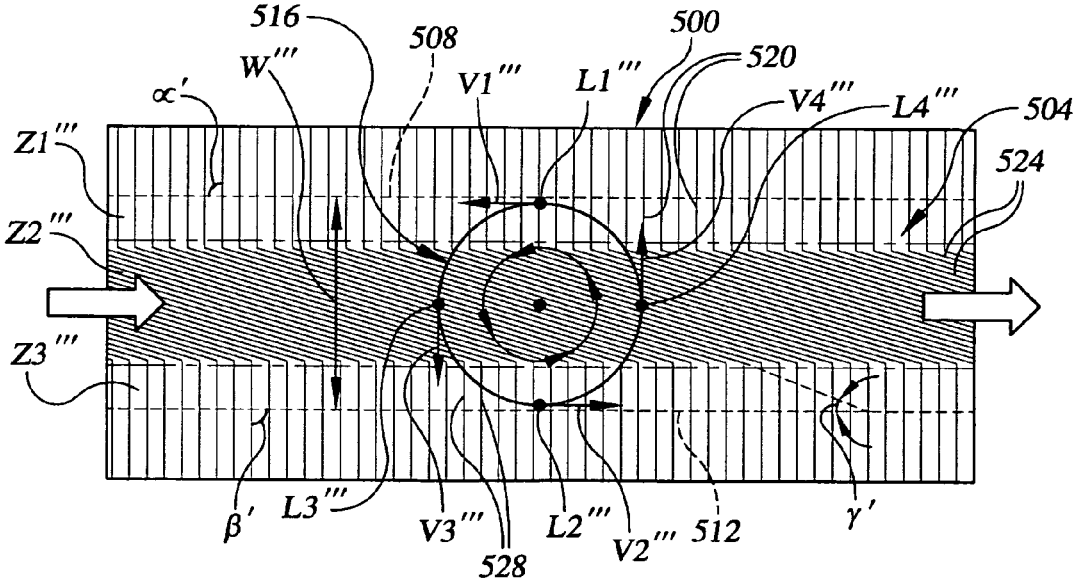
FIG. 4 is a partial plan view of a belt-type polishing pad of the present invention.

FIG. 4 illustrates the present invention in the context of a continuous belt-type polishing pad 500. Like rotary polishing pads 104, 300, 400 discussed above in connection with FIGS. 3A–3C, polishing pad 500 of FIG. 4 includes a polishing region 504 defined by a first boundary 508 and a second boundary 512 spaced from one another by a distance W'" equal to or greater than the diameter of the polished surface (not shown) of wafer 516, depending upon whether or not the wafer is oscillated in addition to rotated during polishing. For belt and web-type pads, inner boundary 168 and outer boundary 172 represent straight lines. Also similar to rotary polishing pads 104, 300, 400, polishing region 504 may be partitioned into three zones Z1'", Z2'" and Z3'" containing corresponding grooves 520, 524, 528 having orientations or orientations and shapes selected based on the direction of certain ones of the velocity vectors of wafer 516, such as velocity vectors V1'", V2'", V3'" and V4'" located, respectively, at locations L1'", L2'", L3'" and L4'". Width W'" of polishing region 504 may be apportioned to zones Z1'", Z2'" and Z3'" in the manner discussed above relative to FIG. 3A.

Other than the shape of polishing region 504 being different from the shape of polishing region of FIG. 3A (linear as opposed to circular) and the locations L3'" and L4'" of velocity vectors V3'" and V4'" being different from locations L3 and L4 of FIG. 3A in a similar manner, the principles underlying the selection of the orientations of grooves 520, 524, 528 are essentially the same as discussed above relative to FIG. 3A. That is, it is desirable that grooves 520 in zone Z1'" be at a large angle with respect to velocity vector V1'", grooves 524 in zone Z2'" be at a large angle with respect to velocity vectors V3'" and V4'" and grooves 528 in zone Z3'" be at a large angle with respect to velocity vector V2'". These desires may be satisfied in the same manner as discussed above relative to rotary polishing pads 104, 300, 400, i.e., by making grooves 520 at a large angle with respect to first boundary 508 of polishing region 504, making grooves 524 parallel, or at a small angle with respect to, first and second boundaries 508, 512 and making grooves 528 at a large angle with respect to second boundary 512.

Generally, these goals may be satisfied by making grooves 520 form an angle $\alpha'$ with first boundary 508 of about 60° to 120°, more preferably about 75° to 105°, making grooves 520 form an angle $\beta'$ with first or second boundary 508, 512 of about −30° to 30°, more preferably −15° to 15°, and making grooves 528 form an angle $\gamma'$ with second boundary 512 of about 60° to 120°, more preferably about 75° to 105°. It is noted that although grooves 520, 524, 528 are connected to one another so as to form continuous channels, this need not be so. Rather grooves 520, 524, 528 may be discontinuous, e.g., in the manner of grooves 424 of FIG. 3C. Translating circular grooves 424 of FIG. 3C to belt-type polishing pad 500 of FIG. 4, grooves 524 in zone Z2'" would be linear and parallel to first and second boundaries 508, 512. However, if grooves 520, 524, 528 are connected to one another, transitions may be abrupt (as shown) or more gradual, e.g., similar to first and second transitions 200, 204 of FIG. 3A.

What is claimed is:

1. A polishing pad suitable for polishing at least one of magnetic, optical and semiconductor substrates, comprising:

(a) a polishing layer having a polishing region defined by a first boundary defined by a trajectory of a first point on the polishing pad and a second boundary defined by a trajectory of a second point on the polishing pad, the second boundary being spaced from the first boundary, a first zone proximate the second boundary, a second zone between the second boundary and the first boundary, and the third zone proximate the first boundary;

(b) a plurality of first large-angle grooves, each at least partially contained within the polishing region proximate the first boundary and being 45° to 135° at a point of intersection with the first boundary and in the third zone;

(c) a plurality of second large-angle grooves, each at least partially contained within the polishing region proximate the second boundary and being 45° to 135° at a point of intersection with the second boundary and in the first zone; and (d) at least one small-angle groove contained within the polishing region and between the plurality of first large-angle grooves and the plurality of second large-angle grooves and being −30° to 0° or 0° to 30° with respect to the trajectory of the first boundary and the second boundary, and in the second zone.

2. The polishing pad according to claim 1, wherein the polishing pad is a rotary polishing pad.

3. The polishing pad according to claim 2, wherein each one of the plurality of first large-angle grooves and each one of the plurality of second large-angle grooves are substantially radial relative to the rotational axis of the polishing pad.

4. The polishing pad according to claim 1, wherein the at least one small-angle groove is a spiral groove.

5. The polishing pad according to claim 1, further comprising a plurality of small-angle grooves, wherein each one of the plurality of small-angle grooves connects a corresponding respective one of the plurality of first large-angle grooves to a corresponding respective one of the plurality of second large-angle grooves.

6. The polishing pad according to claim 2, further comprising a plurality of the small-angle grooves, wherein each one of the plurality of the small-angle grooves is circular.

7. The polishing pad according to claim 1, wherein the polishing pad is a linear belt.

8. The polishing pad of claim 1, wherein the plurality of the first large angle grooves arc at 60° to 120° at the point of intersection with the first boundary and in the third zone; and the plurality of the second large-angle grooves are at 60° to 120° at the point of intersection with the second boundary and in the first zone.

9. A method of polishing a magnetic, optical or semiconductor substrate, comprising the step of polishing the substrate with a polishing pad and polishing medium, the polishing pad comprising:

(a) a polishing layer having a polishing region defined by a first boundary defined by a trajectory of a first point on the polishing pad and a second boundary defined by a trajectory of a second point on the polishing pad, the second boundary being spaced from the first boundary, a first zone proximate the second boundary, a second zone between the second boundary and the first boundary, and a third zone proximate the first boundary;

(b) a plurality of first large-angle grooves, each at least partially contained within the polishing region proximate the first boundary and being 45° to 135° at a point of intersection with the first boundary and in the third zone;

(c) a plurality of second large-angle grooves, each at least partially contained within the polishing region proximate the second boundary and being 45° to 135° at a point of intersection with the second boundary and in the first zone; and (d) at least one small-angle groove contained within the polishing region and between the plurality of first large-angle grooves and the plurality of second large-angle grooves and being −30° to 0° or 0° to 30° with respect to the trajectory of the first boundary and the second boundary, and in the second zone.

10. The method of claim 9 wherein the polishing pad polishes a semiconductor wafer and the plurality of first large-angle grooves, the plurality of second large-angle grooves and the at least one small-angle groove are adjacent the semiconductor wafer simultaneously for at least a portion of the polishing.

* * * * *